US005881572A

United States Patent [19]

Plemmons et al.

[11] Patent Number: 5,881,572

[45] Date of Patent: Mar. 16, 1999

[54] APPARATUS FOR FORMING REINFORCED GLOVE

[75] Inventors: Harold F. Plemmons, Naples, Fla.; James R. Peet, Nottinghamshire, England

[73] Assignee: Ansell Edmont Industrial, Inc., Wilkesboro, N.C.

[21] Appl. No.: 954,133

[22] Filed: Oct. 20, 1997

Related U.S. Application Data

[62] Division of Ser. No. 738,035, Oct. 24, 1996, Pat. No. 5,689,976.

[51] Int. Cl.[6] ..... D04B 7/34

[52] U.S. Cl. ..... 66/65; 66/174

[58] Field of Search ..... 66/64, 65, 174

[56] References Cited

U.S. PATENT DOCUMENTS

| | | | |
|---|---|---|---|
| 353,020 | 11/1886 | Collins | 66/174 |
| 654,730 | 7/1900 | Hanna | 2/159 X |
| 2,342,547 | 2/1944 | Kuehnel | 66/174 X |
| 2,632,171 | 3/1953 | Kuh | 2/161.6 |
| 2,719,980 | 10/1955 | Haupt et al. | 2/159 |
| 2,877,635 | 3/1959 | Powell | 66/174 X |
| 3,729,400 | 4/1973 | Colehower | 2/161 |
| 3,788,103 | 1/1974 | Asai | 66/65 |
| 4,756,027 | 7/1988 | Buenos et al. | 2/159 X |
| 4,779,289 | 10/1988 | Prouty | 2/159 X |
| 5,239,846 | 8/1993 | Kitaura et al. | 66/174 |

FOREIGN PATENT DOCUMENTS

| | | | |
|---|---|---|---|
| 2059-751 | 5/1977 | Japan | 66/65 |
| 5-117946 | 5/1993 | Japan | 66/65 |
| 80/00803 | 4/1981 | WIPO | 2/161.6 |

OTHER PUBLICATIONS

Fully Automatic Seamless Glove Knitting Machine Operation Manual; Mar. 1975, Matuya Corporation.

Fullp Automatic Seamless Glove Knitting Machine Parts List; Undated Matsuya Corporation.

Fully Automatic Seamless Glove Knitting Machine SFG–III 1987 Shima Seiki Mfg., Ltd.

*Primary Examiner*—John J. Calvert

*Attorney, Agent, or Firm*—Rhodes Coats & Bennett, L.L.P.

[57] ABSTRACT

A knitted glove including a thumb and a body, a crotch defined between the thumb and the body, and a thickened knitted portion along at least a portion of the crotch. The present invention is further directed to a method and apparatus for forming such a knitted glove.

3 Claims, 11 Drawing Sheets

APPARATUS FOR FORMING REINFORCED GLOVE

This application is a division of application Ser. No. 08/738,035, filed Oct. 24, 1996, now U.S. Pat. No. 5,689, 976.

FIELD OF THE INVENTION

The present invention is directed to gloves, and, more prarticularly, to a glove having a reinforced section and a method and apparatus for forming the same.

BACKGROUND OF THE INVENTION

In many applications, work gloves are exposed to an inordinate amount of wear in the area between the thumb and index finger. As a result, this area is often the primary wear point of the glove so that wear through at this point becomes the failure mechanism of the glove. This is particularly true in the case of knit gloves. A method which has been used with some degree of success to extend the life of work gloves is to sew the front and back plies of the glove together along the crotch between the thumb and the fourth finger and/or upper palm. In this way, additional fabric is provided in the wear zone.

The method of sewing as described above suffers from several significant drawbacks. The added step of sewing adds significant time to the manufacturing process and requires additional sewing equipment. The placement of the sewn seam is typically done manually so that the placement of the seam is inconsistent. Often, this gives the appearance of inferior quality. Moreover, a margin of error is needed for the sewing operation to ensure that all of the stitches enter both plies of the fabric. As a result, the seam is generally located farther inwardly from the edge of the fabric than is necessary, resulting in an inefficient use of the overlap of the plies and unneeded and cumbersome bulk.

Thus, there exists a need for a work glove having reinforcement in the crotch area between the thumb and index finger, which may be efficiently and cost effectively manufactured. Such a glove should preferably have the reinforced sections appear well integrated with the remainder of the glove and not be unnecessarily bulky. Further, there exists a need for a method of making such a glove which provides for consistent results and which does not substantially increase the time or equipment required to form the glove. Moreover, there exists a need for an apparatus for forming such a glove which accomplishes the above advantages. Preferably, the apparatus would allow the retrofit of existing, conventional glove machines to produce gloves having the above-noted features and advantages.

SUMMARY OF THE INVENTION

The present invention is directed to a knitted glove including a thumb and a body. A crotch is defined between the thumb and the body. The glove further includes a thickened knitted portion along at least a portion of the crotch. Preferably, the thickened portion is substantially coextensive with the crotch. The glove may include a finger. Preferably, a thickened portion extends along at least a portion of the finger adjacent the thumb.

The present invention is also directed to a glove having a front ply, a back ply, a thumb, and an upper palm. The thumb has an inner edge adjacent the upper palm and the upper palm has an inner edge adjacent the thumb. The front ply has at least one wale extending along at least one of the inner edges which is interknitted with at least one wale of the back ply to form a reinforced section.

Preferably, the reinforced section extends along each of the inner edge of the thumb and the inner edge of the upper palm. The glove may include a finger adjacent the thumb. The reinforced section extends along an edge of the finger adjacent the thumb. The front ply may have two or more wales interknitted with two or more wales of the back ply.

The present invention is further directed to a method for forming a glove. A glove is knitted having a thumb and a body of a first thickness. A crotch portion of a thickness greater than the first thickness is knitted between the thumb and the body. The step of knitting the glove may include knitting a finger. The crotch extends along at least a portion of the finger adjacent the thumb.

The present invention is also directed to a method for forming a glove including knitting a glove having a front ply, a back ply, a thumb, and an upper palm. The thumb has an inner edge adjacent the upper palm and the upper palm has an inner edge adjacent the thumb. The front and back plies are interknit to one another along at least one of the thumb inner edge and the upper palm inner edge.

Preferably, the step of interknitting includes interknitting the front and back plies to one another along both the thumb inner edge and the upper palm inner edge. The step of interknitting may include interknitting at least two wales of the front ply with two wales of the back ply. Further, at least one finger may be knit, the finger having front and back plies and an inner edge adjacent the thumb. The front and back plies of the finger are interknit along the inner edge of the finger.

The present invention is further directed to an apparatus for knitting a glove. The apparatus includes two beds of needles, a yarn inlay mechanism, and a control mechanism for the needles and the yarn inlay mechanism. The control mechanism causes the yarn inlay mechanism and the needles to cooperatively form a glove body of a first thickness and a crotch portion of a thickness greater than the first thickness.

The present invention is also directed to an apparatus for forming a glove of the type having a front ply, a back ply, an upper palm having an inner edge, and a thumb having an inner edge adjacent the inner edge of the upper palm, and a reinforced section including at least one wale of the front ply interknit with a wale of the back ply along at least one of the inner edge of the upper palm and the inner edge of the thumb. The apparatus includes a carriage movable through a first path and a second path. A series of first needles are operative to knit the back ply when the carriage moves through the first path. A series of second needles are operative to knit the front ply when the carriage moves through the second path. A needle selector selects at least one of the front needles to knit when the carriage moves through the first path during the formation of at least one of the upper palm and the thumb. The first needle or needles, in cooperation with the second needle or needles, interknits the wale or wales of the front ply with the wale or wales of the back ply to form the reinforced section.

BRIEF DESCRIPTION OF THE DRAWINGS

The invention will be better understood after a reading of the Detailed Description of the Preferred Embodiments and a review of the drawings in which.

DETAILED DESCRIPTION OF THE PREFERRED EMBODIMENT

Figure 1:
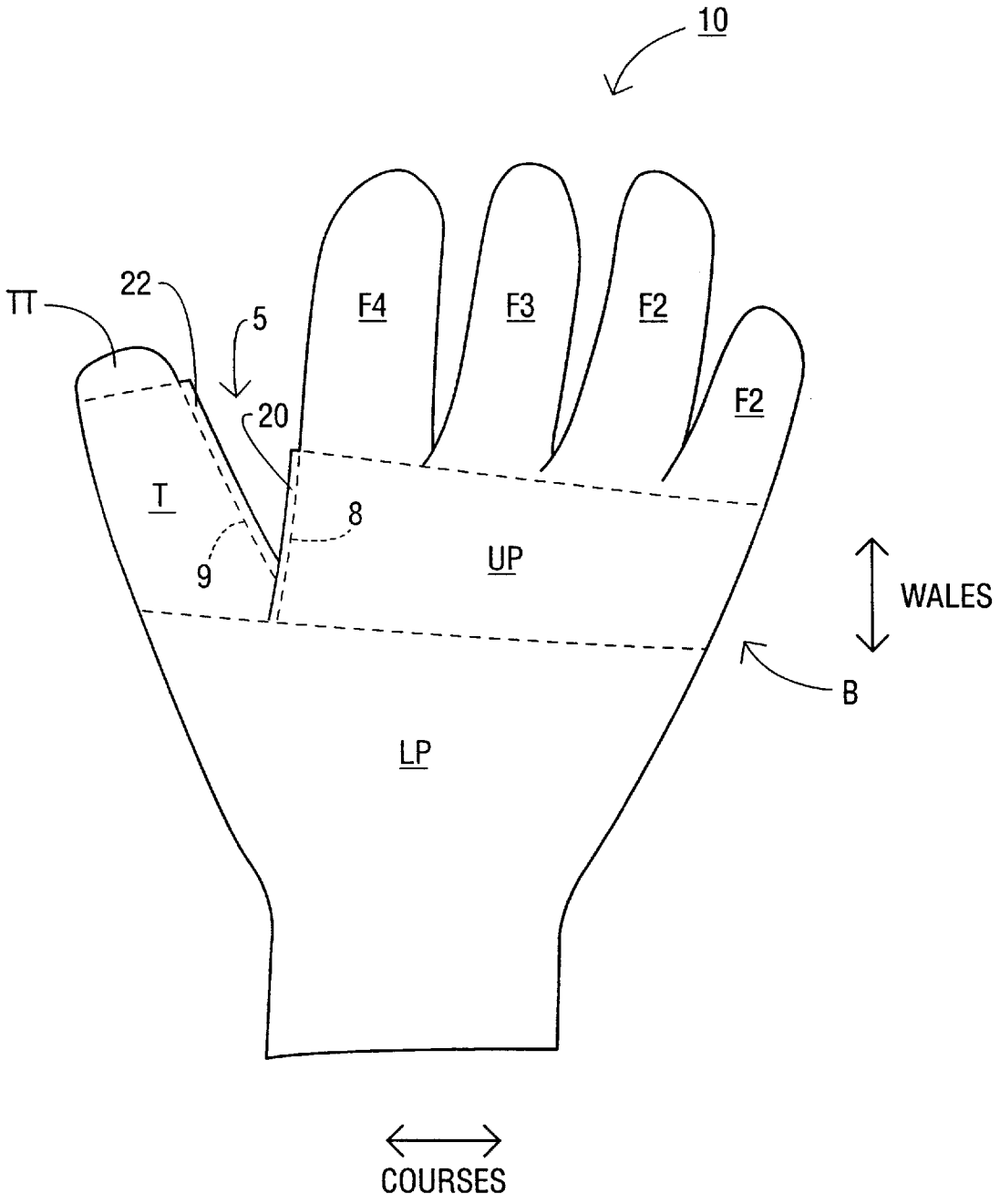
FIG. 1 is a front elevational, schematic view of a glove as formed according to the present invention.

With reference to FIG. 1, a glove 10 according to the present invention is shown therein. In conventional fashion, glove 10 includes fingers F1, F2, F3, and F4, upper palm UP, lower palm LP, thumb tip TT, and thumb T. Upper palm UP and lower palm LP together make up body B. Thumb T and upper palm UP define crotch 5 therebetween. In accordance with the present invention, glove 10 is further provided with upper palm reinforcement section 20 and thumb reinforcement section 22 provided on the opposing inner edges 8 and 9 of upper palm UP and thumb T, respectively. Reinforcement section 20 may extend up along the edge of finger F4 adjacent the thumb, as well.

Reinforcement sections 20 and 22 together serve to rim the crotch between the thumb and the upper palm. Each reinforcement consists of at least one front wale and one back wale interknit with the front wale. Each reinforcement section 20, 22 may consist of more than one interknit set of wales. The interknit wale or wales preferably extend outwardly beyond the edgemost wale of the fourth finger, but may be aligned therewith. The construction of reinforcement sections 20 and 22 will be better appreciated upon a reading of the description of the method and apparatus for forming glove 10 which follows.

The general method of forming glove 10 is as follows. The actual mechanisms for and interrelated control of the various operations will be discussed in more detail below with regard to the apparatus of the present invention. Generally, the method may be practiced on a standard Shima Seiki glove knitting machine of any standard gauge which has been appropriately constructed or modified, for example as described below. However, it will be appreciated by those of ordinary skill in the art that other types of glove knitting machines may be used. Those of ordinary skill in the art are well acquainted with Shima Seiki machines; nonetheless, additional details can be seen in these patents: Japanese Pat. 64-12843; Japanese Pat. 64-14353; Japanese Pat. 64-14352; Japanese Pat. 1-14352; Japanese Pat. 2-40777; U.S. Pat. No. 5,239,846; and U.S. Pat. No. 3,788,103.

Figure 12:
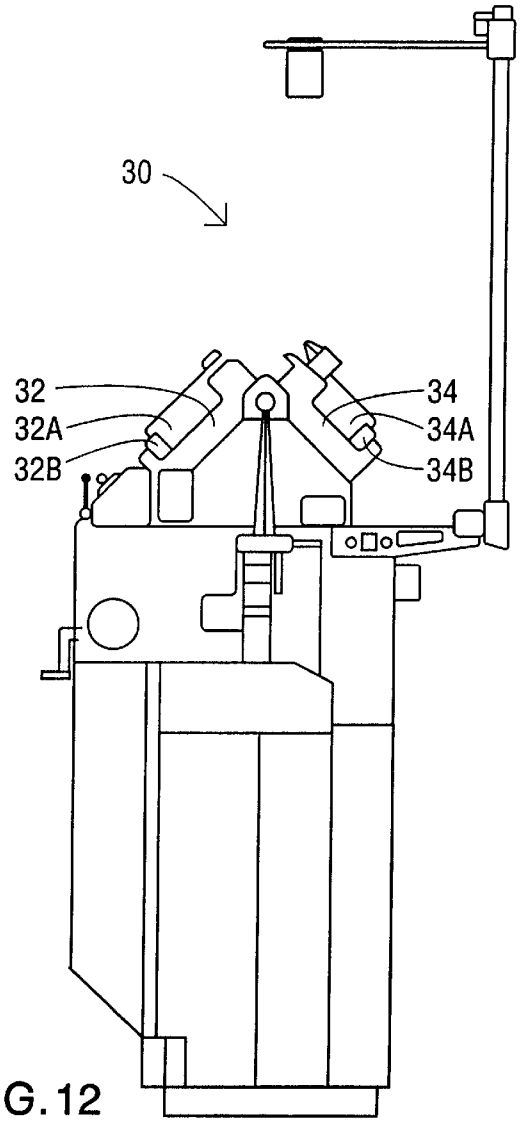
FIGS. 11 and 12 are front and side elevational views, respectively, of the knitting machine.
Figure 11:
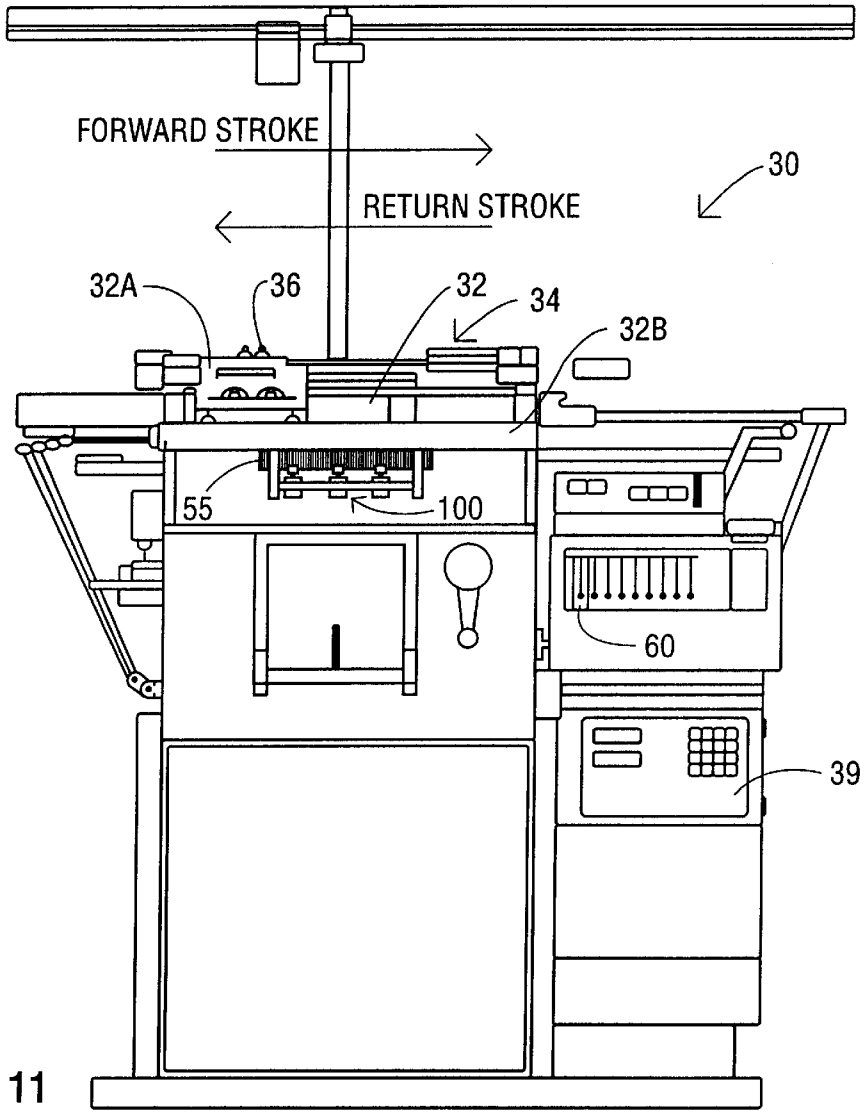

As seen in FIG. 12, a glove knitting machine 30 of the type described above includes two slanted beds 32, 34 of needles forming a "V" configuration. Rear bed 34 knits one side (the back side) of the glove while front bed 32 knits the other side (the front side) of the glove. Each needle bed has its own carriage 32A, 34A and guide track 32B, 34B. Typically, the needles are selected by a rotatable drum associated with each bed. The drum has spacers of different lengths. When the drum is rotated to various prescribed positions, a given spacer will be in contact with a jack selector each associated with a needle. The spacers displace the jack selectors which, in turn, displace the desired needles into the ready position. The knitting machine includes suitable linkages and cam mechanisms to control the drums so as to achieve the proper needle selections for each portion and transition of the glove. In this way, the selected needles are placed in a prescribed location with respect to the path of the respective front or rear carriage (not shown), which rides along its track parallel to the respective needle bed. The carriages, if enabled to knit in a given stroke (as discussed below), will cause the selected needles to reciprocate as they go across the selected needle bats. A yarn feeder 36 runs back and forth along the length of the "V" and lays a continuous yarn into the needles as they extend upwardly when actuated.

Conventionally, the carriage of the front bed is disabled on the return stroke (i.e., right to left as viewed from the front of the machine) and the carriage of the rear bed is disabled on the forward stroke (i.e., left to right), so that the needles of the front and rear beds do not knit on the same stroke. In the case of the Shima Seiki machine, for example, the front bed carriage is disabled on the forward stroke by raising a rail 72 (see FIG. 9) to a raised position. The front bed carriage will, however, knit on the forward stroke if rail 72 is lowered as shown in dotted lines in FIG. 9, as occurs conventionally when the first course (i.e., the closure) of the fingertips and thumb tip are formed.

Figure 2A:
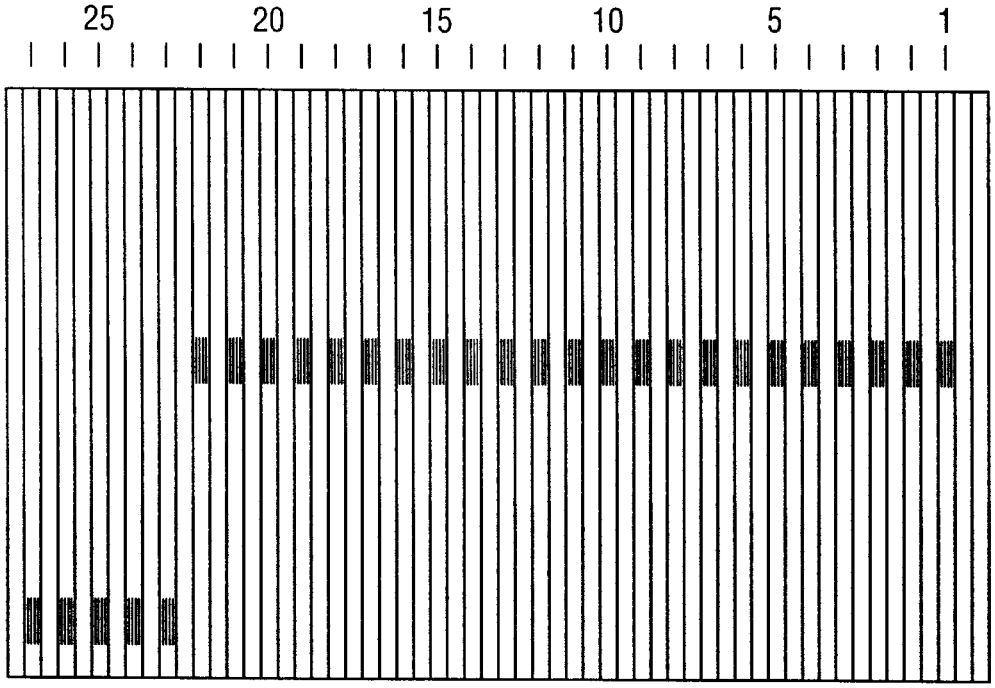
FIGS. 2A–2C are schematic diagrams of the front needle bed showing various needle selection patterns for forming the glove according to the present invention.
Figure 2B:
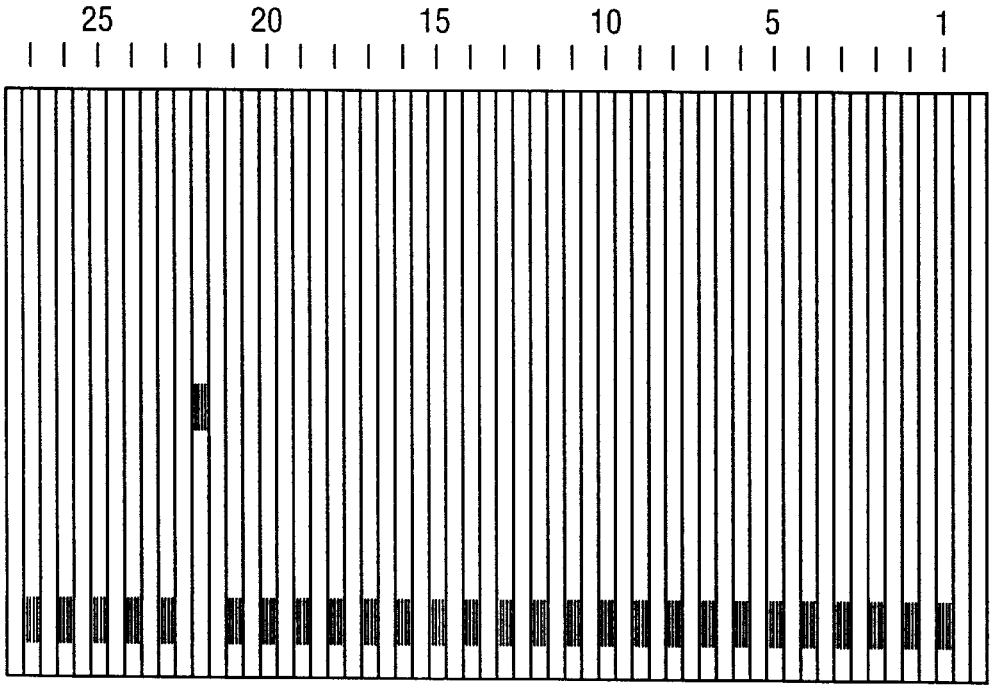
Figure 2C:
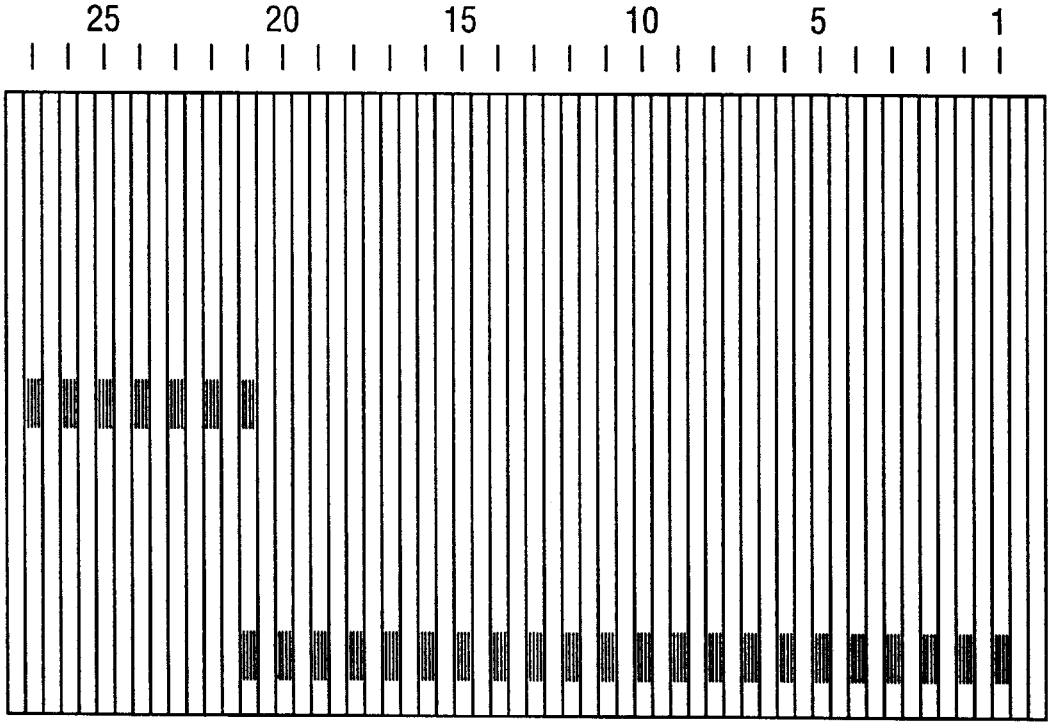
Figure 9:
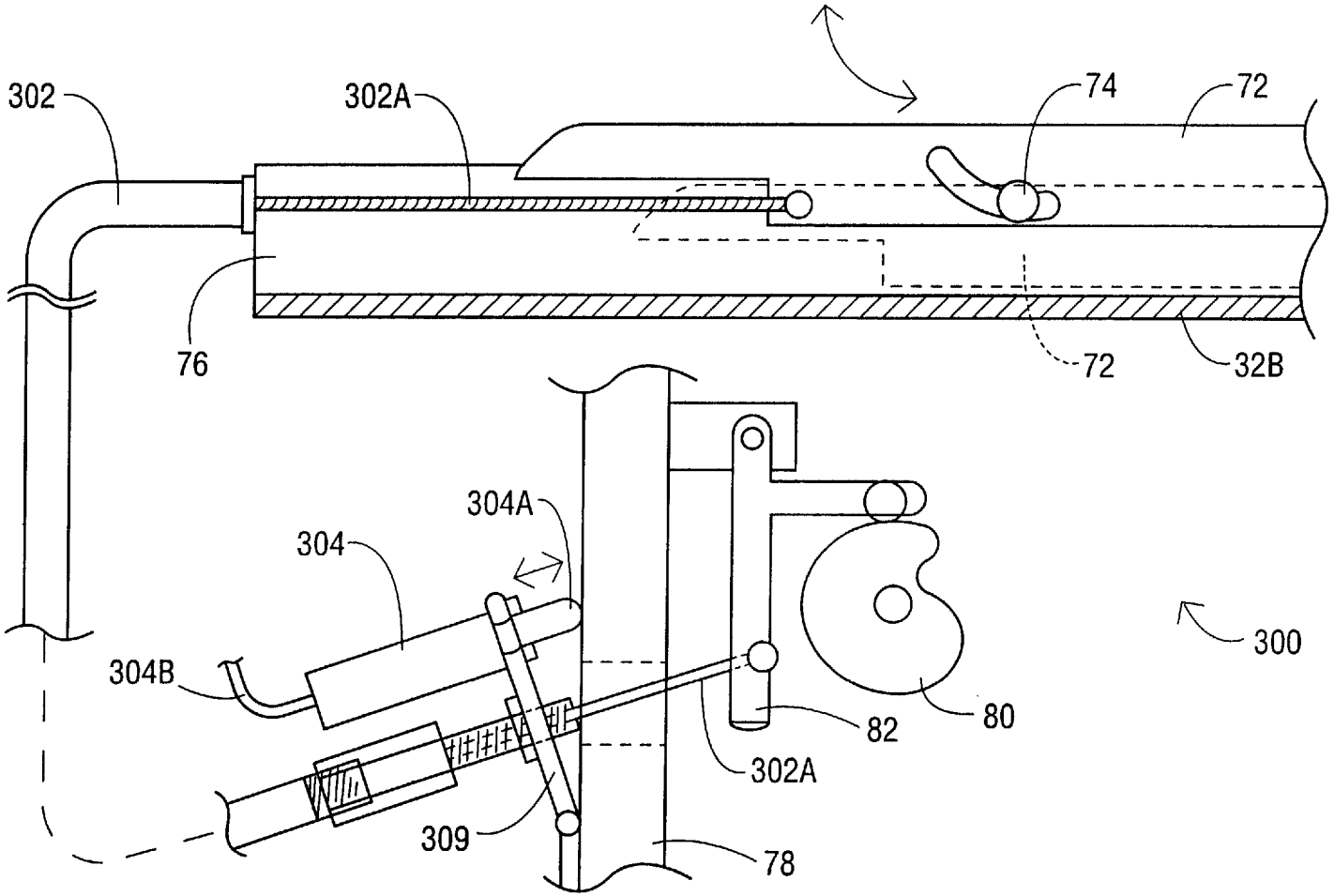
FIG. 9 is a fragmentary, side view of the carriage track and control bar and the front rail controller of the present invention, the track shown in cross section.

The preferred sequential method for forming glove 10 will be discussed with reference to FIG. 1, FIGS. 2A–2C, and FIG. 9. FIGS. 2A–2C are schematic diagrams showing the selection and non-selection of needles for a given stroke of the front bed carriage. In practice, a needle is disabled when its bat is down within its slot and is enabled when its bat extends above the slot and is positioned to engage the appropriate cam of the carriage. Where the dot for a given needle slot is down, the needle is indicated as disabled. Where the dot for a given needle slot is up, the butt of the needle is presented and the needle is enabled for return strokes of the front carriage, and for forward strokes of the front carriage if rail 72 is in the lowered position. FIG. 9 shows a fragmentary view of front carriage guide track 32B. Also shown is the position of the guide rail 72 indicated as up in solid lines and down in dotted lines. The rear needle bed, rear carriage, and rear guide track will perform in a wholly conventional manner for forming non-reinforced gloves.

In forming glove 10, fingers F1 to F4 are first formed in conventional fashion. Upper palm UP is begun with a return stroke. On this first and each subsequent return stroke, the needles of the front needle bed are selected as shown in FIG. 2A. On the forward strokes, the knitting machine selects the needles of the rear bed normally used to knit the back of the upper palm. Additionally, the needles of the front bed are selected as shown in FIG. 2B. Rail 72 is held in the lower position so that the front carriage causes needle #22 of the front bed to knit on the forward stroke.

The result of the concurrent knitting of the needles on the rear bed with needle #22 of the front bed is that the stitching passes from the first selected needle on the rear bed to needle

#22 of the front bed, and then back to the next needle of the rear bed. More particularly, on a first return stroke, the front bed knits the front ply. Included in this course is a front ply stitch knit by front needle #22. On the following forward stroke, the yarn feeder lays yarn into the hook of front needle #22 which pulls the yarn down and holds it, thereby creating a "laid in stitch". Then, the yarn feeder lays yarn into the first and subsequent rear needles which each form a respective stitch of the back ply. On the second return stroke, the front needle bed knits the next course of the front ply. During this second return stroke, front needle #22 knits three yarns: 1) the yarn of the previous front ply stitch which was held normally as the last stitch on front needle #22; 2) the laid in and held yarn from the previous forward stroke; and 3) the newly laid yarn of the current (second) return stroke from the yarn feeder. Front needle #22 knits the second return stroke stitch into the first return stroke stitch. As a result, the front and back plies are joined because both have the laid in segment of yarn from the first forward stroke knit into their respective stitches. Thus, the front and back portions of the glove are knitted together and have the yarn intermingled from front to back, integrating the front and back in the reinforced areas 20 and 22.

Because the chosen front needle #22 precedes the first needle of the rear bed used on the upper palm on the forward stroke, the reinforced wale formed will make the upper palm one wale wider than the fingers combined. As an alternative to the set up described above, the front needle used to form the reinforcement may be located after the first rear needle on the forward stroke. In this way, the upper palm would have the same number of wales as the fingers combined with the reinforced section appearing as a reinforced portion of the wale which extends down the edge of the fourth finger to the crotch.

After the last course of the upper palm is knit as described above, the machine knits the thumb tip in conventional fashion. Thereafter, beginning with a return stroke of the carriage, the front bed needle configuration as shown in 2C is selected. This needle selection is used for each return stroke in forming the thumb T. For each forward stroke, only needle #22 is selected on the front bed (as shown in FIG. 2B) and carriage rail 72 is held in the lowered position so that needle #22 knits on each of the forward strokes. The rear needle bed performs in conventional fashion. Thus, again, the cooperative action of needle 22 on the front bed and the needles on the rear bed causes the front and back wales at needle #22 to be interknit. The cooperative action of the needles and the resulting construction will be appreciated from the foregoing discussion regarding the formation of the upper palm.

Thereafter, the crossover between the thumb T and upper palm UP, and then lower palm LP are formed in conventional manner, each of the front and rear beds performing in normal fashion.

It will be appreciated from the foregoing that in the forward strokes in forming the reinforced sections more than one needle could be selected so that each reinforced section has two or more interknitted front and back wales.

It will be appreciated that the twenty-seven (27) needles indicated in the diagrams and as discussed herein are for the purposes of illustration only. Typical knitting machines will in fact use greater than 27 needles in the formation of a glove of this type.

The method as described above is preferably practiced using an apparatus according to the present invention as described below. The apparatus includes, generally, a Shima Seiki SFG-III, Number 19214, Fully Automatic Seamless Glove Knitting Machine (available from Shima Seiki of Wakayama, Japan) modified and supplemented as described below. The operation of the Shima Seiki SFG-III machine is described in *SFG-III Fully Automatic Seamless Glove Knitting Machine, Instruction Manual—Parts List SFG Number* 19214~, available from Shima Seiki, which is incorporated herein by reference in its entirety. It will be appreciated that similar type knitting machines may be used in place of the Shima Seiki machine without departing from the invention.

With reference to FIGS. 3–10, the following components, each of which will be discussed in greater detail below, form a part of the apparatus for forming gloves 10 in addition to the Shima Seiki machine. Needle selection assembly 100 serves to select the front bed needles for the return strokes in forming the courses which intersect reinforced sections 20, 22. Front rail controller 300 serves to lower rail 72 of the front guide track to enable the carriage to actuate selected front bed needles on the forward strokes in forming the courses with reinforcement. Control system 200 serves to coordinate the operation of needle selection assembly 100 and front rail controller 300 with the conventional operation of the knitting machine. Additionally, the front selection drum is configured such that front needle #22 is selected on each of the forward and return strokes which form the courses having reinforcement. The front drum is directly controlled by the existing drum control mechanism of the knitting machine. The rear needle bed, rear carriage track, and related mechanisms are all controlled in conventional manner by the existing mechanisms of the knitting machine throughout the formation of the glove.

Each of the above noted systems and components will be discussed in greater detail immediately herebelow. Thereafter, the sequential operation of the components in the process of forming a glove according to the present invention will be discussed.

Figure 3:
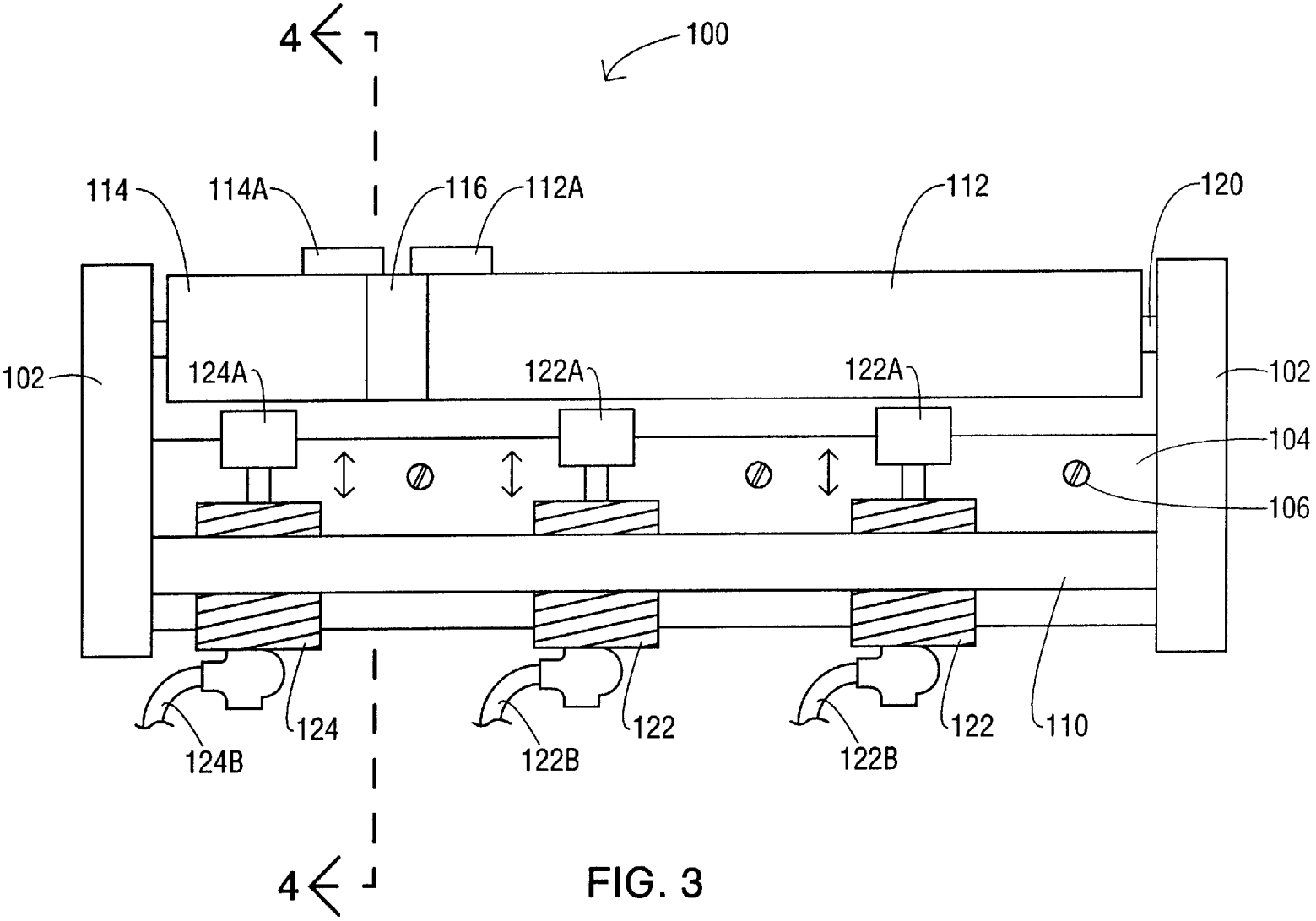
FIG. 3 is a front, elevational view of a needle selection assembly according to the present invention.
Figure 4:
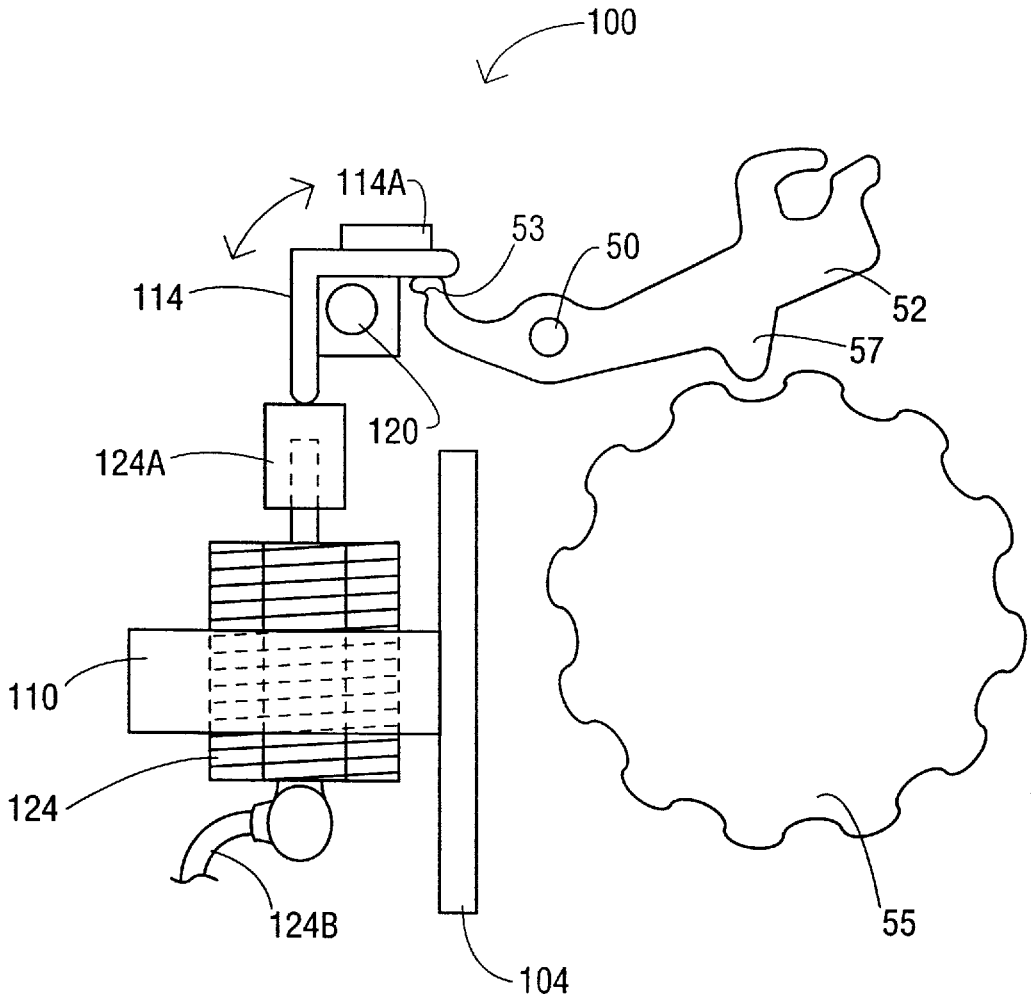
FIG. 4 is a side, fragmentary view of the needle selection assembly of FIG. 3 mounted on the knitting machine.

FIGS. 3 and 4 show needle selection assembly 100. Assembly 100 is fixedly secured to the knitting machine by bolts 106 which extend through bores in mounting plate 104. Side blocks 102 are secured to mounting plate 104 at either end thereof. Cross block 110 extends between and is secured to side blocks 102, and is also secured to mounting plate 104. Pivot rod 120 is secured at each end thereof to a respective side block 102. Blocks 112, 114, and 116 are rotatably mounted on rod 120 independently of each other. Tabs 112A and 114A are fixedly secured to bars 112 and 114, respectively, and each overlap bar 116. As a result, if either of bars 112 and 114 are rotated forwardly (i.e., into the paper), bar 116 will rotate forwardly therewith.

Air cylinders 122A and 124A are rigidly mounted in cross block 110. The air cylinders are actuated by air from hoses 122B and 124B to reciprocate pistons 122A and 124A as indicated by the arrows. When air cylinders 122 are actuated, pistons 122A are displaced upwardly, in turn causing bar 112 (and thereby bar 116) to rotate forwardly. When air cylinders 122 are deactuated, pistons 122A return to the retracted state, allowing bars 112 and 116 to return to the position as shown in FIGS. 3 and 4. Similarly, when air cylinder 124 is actuated, piston 124A is displaced upwardly causing bars 114 and 116 to rotate forwardly. When air cylinder 124 is deactuated, piston 124A retracts, allowing bars 114 and 116 to return to the position of FIGS. 3 and 4.

With reference to FIG. 4, a jack selector 52 and front needle selection drum 55, each forming a part of the knitting machine, are shown therein. A series of side-by-side jack selectors extends along the needle bed, one for each needle.

The drum length extends the width of the series of jack selectors. The front lip of block 114 overlies the end 53 of jack selector 52. As bar 114 pivots upwardly and forwardly when air cylinder 124 is actuated, bar 114 forces end 53 downward, causing jack selector 52 to pivot about fulcrum 50. In this way, the jack selectors lying along bar 114 will select the corresponding needles in the front needle bed (needles #23 to #27) when bar 114 is rotated. Similarly, bar 112, when rotated, will cause the jack selectors therealong to select the corresponding front bed needles (needles #1 to #20). In either case, the jack selectors lying along bar 116 will select the corresponding front bed needles (needles #21 and #22). When the pistons 122A, 124A are retracted, the jack selectors return to their at rest positions (as shown in FIG. 4) due to the bias of existing springs (not shown).

The arrangement of drum 55 and jack selectors 52 is conventional. The position of drum 55 is determined by the internal cam mechanisms of the knitting machine. However, the effect of drum 55 on the jack selectors for a given rotational position of drum 55 may be determined by the operator by inserting or omitting spacers of various lengths, or by similar techniques. When the drum is in a given position, if a spacer is present at a given jack selector, the jack selector will be displaced by abutment between the spacer and projection 57. If no spacer is present at a given jack selector, that jack selector will not be displaced so that the corresponding needle is not selected. For the apparatus of the present invention, a spacer is chosen for the position (s) on the drum indexed for the upper palm and the thumb which only abuts and displaces needle #22.

As noted above, it is necessary to lower rail 72 (see FIG. 9) to enable the front carriage to cause the selected front bed needle to knit on the forward stroke. This task is selectively accomplished by front rail controller 300. In normal operation (i.e., when knitting the fingers and lower palm), piston 304A of air cylinder 304 is extended and bowvden cable 302 is adjusted such that rail 72 is manipulated in conventional fashion by cam 80 and lever 82 of the knitting machine. When the reinforced courses are being formed, piston 304A is retracted so that a greater length of inner cable 302A is inserted into the lower end of the outer cable, lowering rail 72 into groove 76. Rail 72 will remain lowered for so long as piston 304A remains retracted, irrespective of the position of cam 80.

The selection of front bed needles and positioning of the front rail must be coordinated with the operations of the knitting machine. The needle selection assembly 100 and rail controller 300 must be disabled during formation of the non-reinforced courses to allow the knitting machine to function normally. Moreover, the appropriate needle selection bar 112 or 114 must be selected depending on whether the reinforced upper palm is being formed or the reinforced thumb. The controller system interfaces directly with controller cams in the knitting machine and regulates the activity of the needle selection assembly 100 and rail controller 300 in accordance therewith.

Figure 5:
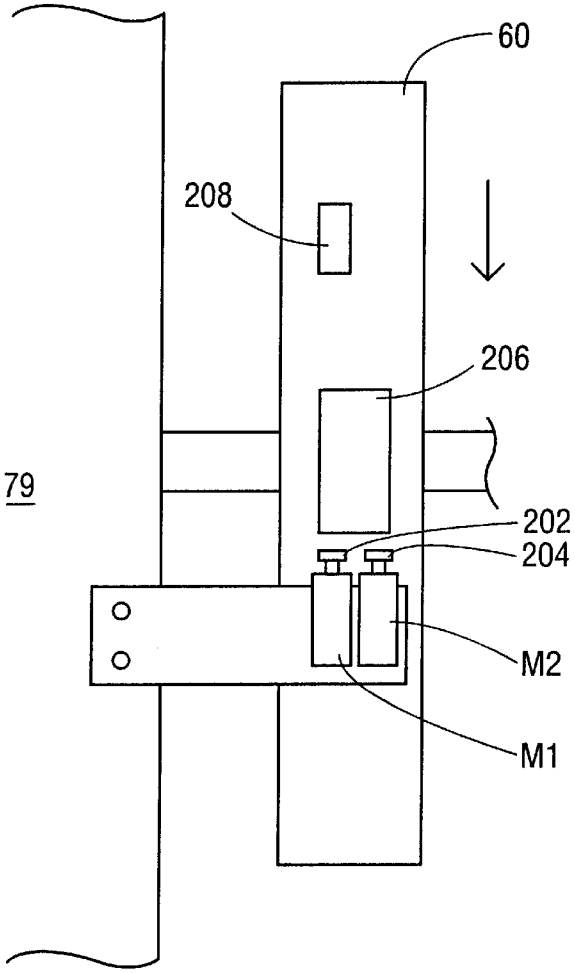
FIG. 5 is a front, elevational view of microswitches forming a part of the control system of the present invention, along with a modified control cam.
Figure 10:
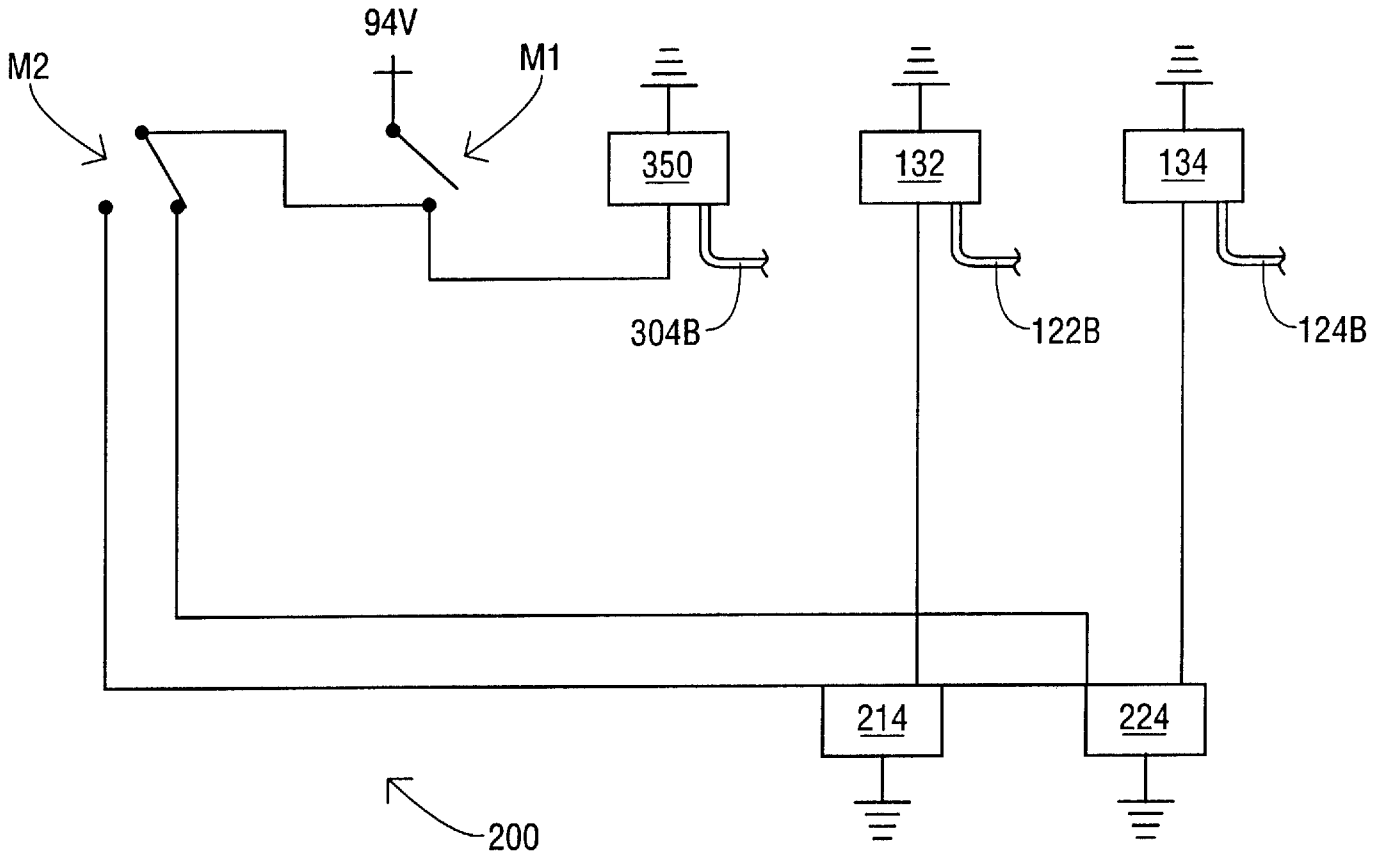
FIG. 10 is a schematic electrical diagram showing the control system of the present invention.

With reference to FIGS. 5 and 10, microswitches M1 and M2 are mounted to the frame 79 of the knitting machine and adjacent control cam 60 of the knitting machine. Microswitches M1 and M2 have depressible roller arms 202 and 204 which, when depressed, transition the respective switches from their normal position to a switched position. Spacers 206 and 208 are affixed at selected locations along the periphery of cam 60. Cam 60 rotates in the direction as indicated by the arrow past roller arms 202 and 204. When microswitches M1 and M2 encounter spacer 206, both roller arms 202 and 204 are depressed until spacer 206 rotates passed them. Following spacer 206 is a region of cam 60 where no spacer is present so that neither of microswitches M1 and M2 are depressed. As cam 60 continues to rotate, roller arm 202 encounters spacer 208 which depresses the roller arm, thereby actuating switch M1 until spacer 208 rotates beyond the switch.

As shown in FIG. 10, microswitch M1 is a normally open switch. When switch M1 is closed by either of spacers 206 and 208, power is provided to solenoid 350. Solenoid 350 controls the flow of air to hose 304B and, when actuated by closure of switch M1, deactuates air cylinder 304 of rail controller 300 allowing piston 304A to retract. Also, when closed, switch M1 provides power to either proximity sensor 214 (when switch M2 is actuated) or proximity sensor 224 (when switch M2 is not actuated). Hence, when both switches are actuated by spacer 206, solenoid 350 (deactuating air cylinder 304) and sensor 214 are actuated. When only switch M1 is actuated by spacer 208, solenoid 350 and sensor 224 are actuated. At all other positions along cam 60, neither switch is actuated and no power flows to each of solenoid 350 and sensors 214, 224.

When the reinforced upper palm is to be knit, the front needle bed selection of FIG. 2A is used on the return stroke and the front needle bed selection of FIG. 2B is used on the forward stroke. Needle selection bar 112 provides the pattern of 2A; the drum of the knitting machine provides the pattern of 2B. It is necessary to actuate bar 112 only on the return strokes and to allow the drum to take over needle selection on the forward strokes. Hence, the actuation of air cylinders 122 must be appropriately synchronized to the strokes of the carriages.

Figure 6:
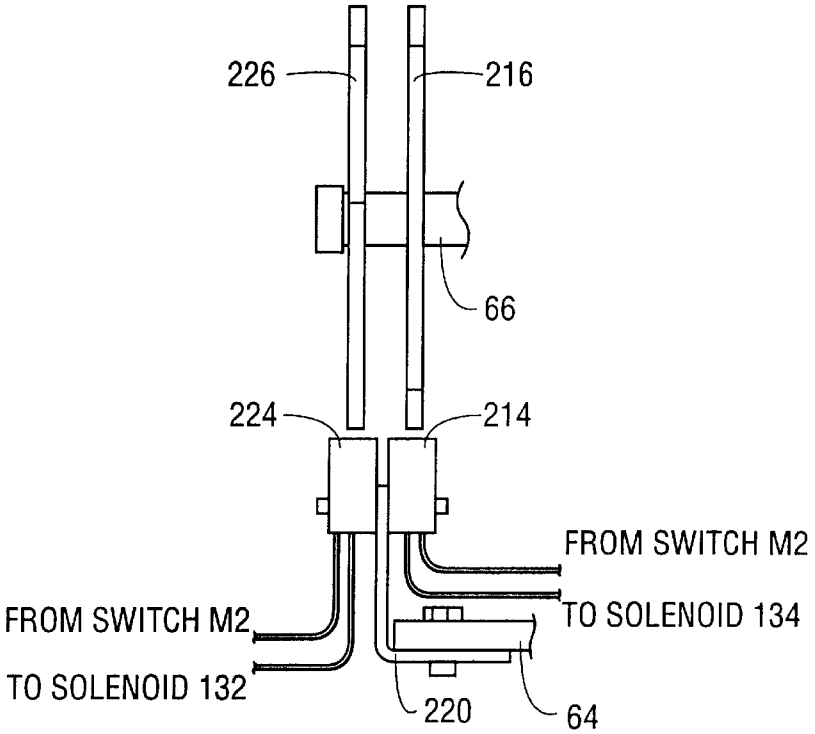
FIG. 6 is a side elevational view of control cams and proximity sensors forming a part of the control system of the present invention.
Figure 8:
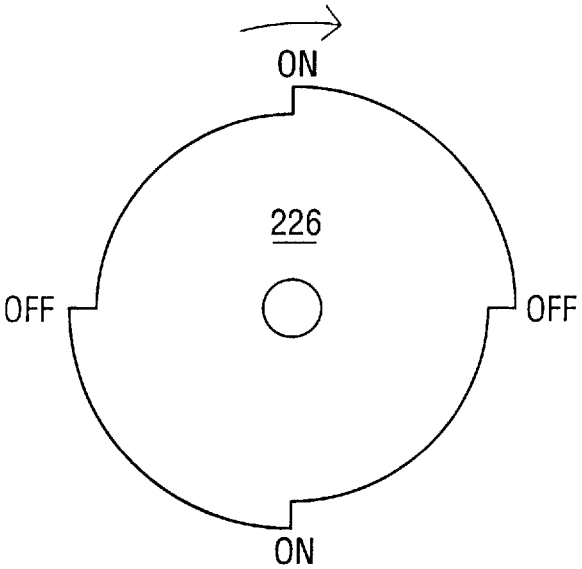
FIG. 8 is a front, plan view of a second control cam.
Figure 7:
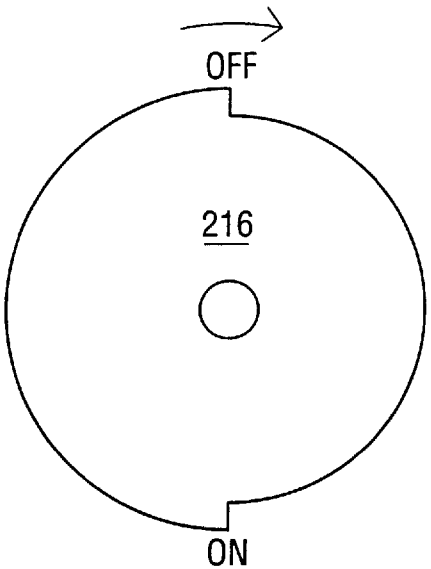
FIG. 7 is a front, plan view of a first control cam.

The foregoing is accomplished by proximity sensor 224 and cam 216 as shown in FIGS. 6, 8, and 10. Cam 216 is mounted on the cam group shaft 66 of the knitting machine for rotation therewith. Shaft 66 makes one complete revolution for each full course (i.e., one forward stroke and one return stroke) of the upper palm. Proximity sensor 214 is mounted to knitting machine frame 64 by bracket 220 and adjacent the periphery of cam 216. Proximity sensor 214 closes and provides power from switch M2 to solenoid 132 when the smaller diameter lobe lies adjacent the sensor. Solenoid 132 is thereby actuated, providing air to air cylinder 122 via hose 122B. This portion of cam 216 corresponds to the return stroke of the reinforced course and, thus, air cylinder 122 remains actuated for the full return stroke. The beginning of the larger diameter lobe of cam 216 causes sensor 214 to open, thereby deactuating air cylinder 132 for the duration of the forward stroke.

When the thumb is being formed, the forward and return strokes are abbreviated to half strokes as is conventional. Thus, one complete revolution of shaft 66 corresponds to two return strokes and two forward strokes, alternately sequenced. The needle selection pattern of FIG. 2C must be made on the return strokes of the reinforced thumb knitting and the needle selection pattern of FIG. 2B must be made on the forward stroke of the reinforced thumb knitting. Similar to the apparatus as described above, this is accomplished by means of proximity sensor 224 and cam 226 (see FIGS. 6 and 8). Cam 226 is configured such that sensor 224 will actuate and deactuate solenoid 134 twice for each revolution of shaft 66. The positions of the steps between the four lobes of the cam are selected to correspond to the transitions between return and forward strokes of the front carriage so that solenoid 134 is actuated during all return strokes and is deactuated during all forward strokes. Actuation and deactuation of solenoid 134 in turn actuates and deactuates air cylinder 114 via hose 124B.

Finally, although the front needle drum is operated wholly by the existing mechanisms of the knitting machine, the profile of the drum itself is modified as compared to a normal, non-reinforced glove making set up. At the location on the drum which is conventionally used to knit the upper palm, the pin or spacer which is normally used to select the needles for knitting the front of the upper palm on the return stroke is replaced with a shorter pin or spacer which only selects needle #22. Likewise, at the location on the drum which is conventionally used to knit the thumb, the pin or spacer which is normally used to select the needles for knitting the front of the thumb on the return stroke is replaced with a shorter pin or spacer which only selects needle #22.

In practice, a glove according to the present invention may be manufactured using the foregoing equipment as follows. Each of fingers F1 to F4 are knit by the knitting machine in conventional manner. The first course of upper palm UP begins with a return stroke and with the knitting of the front side. Just prior to this return stroke, spacer 206 on cam 60 depresses both of switches M1 and M2. This causes (1) solenoid 350 to actuate, in turn deactuating air cylinder 304 and lowering rail 72, and (2) power to be supplied to sensor 214. Substantially simultaneously, the transition from the larger to the smaller diameter lobe of cam 216 will arrive at sensor 214 causing power to flow to solenoid 132 which in turn actuates solenoid 122. The actuation of solenoid 122 displaces bar 112 and bar 116 so as to select needles #1–#20 and #21 and #22. Also substantially simultaneously with the above actions, the knitting machine rotates the front needle selection drum such that the drum selects needle #22. With the foregoing settings (hereinafter "setting A"; FIG. 2A) in place, the return stroke is executed. The return stroke knits the first course of the front of the upper palm. It will be appreciated that, notwithstanding the substitution of needle selection assembly 100 for the front selection drum, the same needles are selected as in conventional operation and the front of the first course is knit by the machine with the needles and the carriage operating in the conventional manner.

At the end of the first return stroke of the upper palm, the transition between the smaller diameter and the larger diameter lobes of cam 216 will arrive at sensor 214 causing sensor 214 to terminate power to solenoid 132. In turn, air cylinders 122 are deactuated and needles #1–#21 are allowed to return to the unselected position. Power is still provided, however, to solenoid 350 so that rail 72 remains lowered. Also, the front drum remains in the original position so that needle #22 is still selected. With these settings (hereinafter "setting B"; FIG. 2B) in place, the forward stroke is executed. On the forward stroke, yarn is first laid into front bed needle #22 and is thereafter laid into the opposite and subsequent needles on the rear bed.

At the completion of the forward stroke, cam 216 is again in position to initiate setting A. The remainder of the upper palm is formed by alternating setting A (return strokes) and setting B (forward strokes) until the last course of the upper palm is formed. The formation of the reinforced section will be appreciated from the discussion of the method of the present invention above. The length of spacer 206 corresponds to the rotational distance traveled by cam 60 to form the upper palm.

After the last course of the upper palm, cam 60 rotates to the position where both of switches M1 and M2 are non-depressed, their roller arms being between spacers 206 and 208. Accordingly, solenoid 350 deactuates, piston 304A is again extended, and rail 72 is thereby again placed in the control of the knitting machine via cam 80. Thumb tip TT is then knit in conventional manner.

After the last course of thumb tip TT is knit, the carriage will be positioned at the end of the forward stroke. Cam 60 will be positioned such that the roller arm of switch M1 is depressed by spacer 208. As a result, power is supplied to solenoid 350 which in turn causes piston 304A to retract, lowering rail 72. Power is also supplied to proximity sensor 224. Cam 226 is positioned such that the transition from a smaller diameter to a larger diameter lobe has arrived at sensor 224. As a result, power is supplied through sensor 224 to solenoid 134 which via hose 124B actuates air cylinder 124. Extension of piston 124A rotates bar 114 and bar 116 whereby first bed needles #23–#27 are selected by bar 114 and needles #21 and #22 are selected by bar 116. The front drum is positioned by the knitting machine to select needle #22. With the foregoing settings (hereinafter "setting C"; FIG. 2C) in place, the first return stroke of the thumb is executed.

At the end of the thumb return stroke, cam 226 will be positioned such that the transition from a larger diameter lobe to a smaller diameter lobe of cam 226 will arrive at sensor 224 causing sensor 224 to terminate power to solenoid 134. The front needle bed will assume the pattern of FIG. 2B, needle #22 being selected by the front drum. Air cylinder 304 will remain deactuated so that rail 72 remains lowered With these settings (hereinafter "setting D") in place, the forward stroke is executed. As in the case of the forward strokes of the upper palm, needle #22 of the front bed reciprocates when addressed by the front carriage.

At the completion of the forward stroke, cam 226 is again positioned to initiate setting C. However, it will be noted that cam 226 at this point has only rotated 180° but is again at a transition between a larger diameter lobe and a smaller diameter lobe. The remainder of the thumb is formed by alternating setting C (return strokes) and setting D (forward strokes) until the last course of the thumb is formed. Again, the formation of the reinforced section will be appreciated from the discussion of the method of the present invention above. The length of spacer 206 corresponds to the rotational distance traveled by cam 60 to form the thumb (not including the thumb tip TT).

Following formation of the last course of the thumb, cam 60 rotates to the position where both of switches M1 and M2 are non-depressed, their roller arms being beyond spacer 208. Accordingly, solenoid 350 deactuates, piston 304A is again extended, and rail 72 is thereby again placed in the control of the knitting machine via cam 80. The remainder of the glove is then formed in conventional fashion by the existing components of the knitting machine.

It will be appreciated from the foregoing that on the forward strokes in forming the reinforced upper palm and the reinforced thumb the front drum may be configured such that the drum selects two or more needles on the front bed. As a result, two or more reinforced wales would be formed in each reinforced section.

It will be understood that the glove product as described above may be formed by other methods than described herein without departing from the present invention.

Further, it will be understood that the method according to the present invention may be practiced on apparatus other than that described herein. For example, the method may be practiced using a dedicated knitting machine having control mechanisms integrated with the existing knit control mechanisms which effectuate the same selection and control of the front needles and the front carriage rail. The microswitches may be replaced by direct electrical connection with the microprocessor 39 which controls the knitting machine. However, it will be appreciated that the apparatus of the preferred embodiment is particularly advantageous for retrofitting existing glove knitting machines as it requires very little modification to the machine other than bolting on of the various components.

Figure 13:
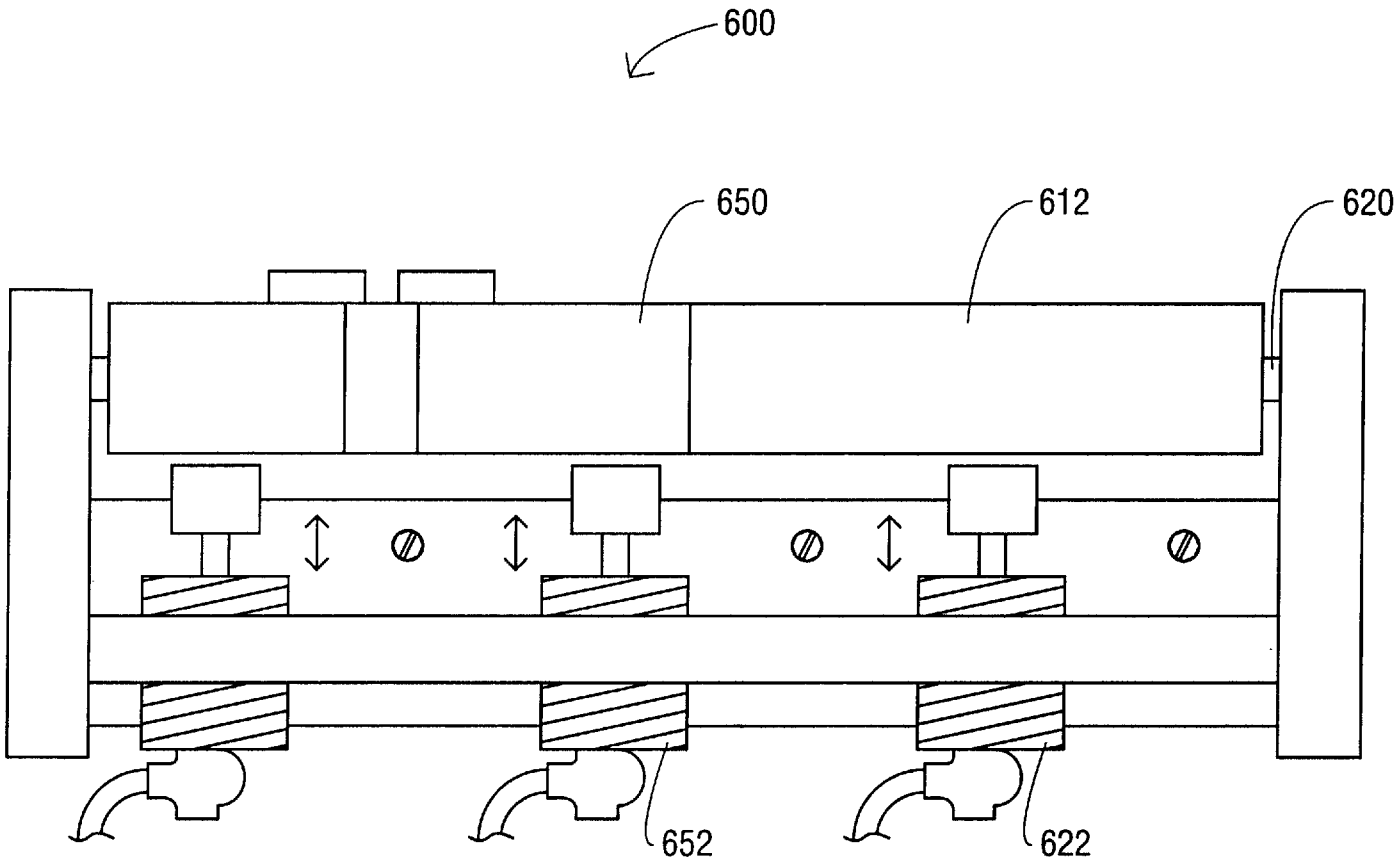
FIG. 13 is a front, elevational view of a modified needle selection assembly according to the present invention for reinforcing the fourth finger of the glove.

The method and apparatus of the present invention may be further modified to provide a reinforced section extending along the thumb side of the fourth finger. With reference to FIG. 13, a modified needle selection assembly 600 is shown therein. Needle selection assembly 600 is substantially the same as needle selection assembly 100 except that bar 112 is segmented into independent bars 612 and 650. Bars 612 and 650 rotate about rod 620 in response to actuation of air cylinders 622 and 652, respectively. A third microswitch and appropriate spacer, or other suitable control means, are provided to control a solenoid (not shown) which in turn controls the actuation and deactuation of air cylinder 652. Air cylinder 652 will be actuated during the return strokes in the formation of the fourth finger and during the return strokes in the formation of the upper palm. Air cylinder 622, by contrast, will only be actuated during the return strokes in the formation of the upper palm. Bar 650 lies adjacent and will select only the needles of the fourth finger. Bar 612 lies adjacent and will select the remaining needles which form the upper palm.

While a preferred embodiment of the present invention has been described, it will be appreciated by those of skill in the art that certain modifications may be made without departing from the scope of the present invention. All such modifications are intended to come within the scope of the claims which follow.

What is claimed is:

1. An apparatus for forming a glove of the type having a front ply, a back ply, an upper palm having an inner edge, and a thumb having an inner edge adjacent the inner edge of the upper palm, and a reinforced section including at least one wale of the front ply interknit with a wale of the back ply along at least one of the inner edge of the upper palm and the inner edge of the thumb, said apparatus comprising:

a) a carriage movable through a first path and a second path;

b) a series of first needles operative to knit the back ply when said carriage moves thrcugh said first path;

c) a series of second needles operative to knit the front ply when said carriage moves through said second path; and d) a needle selector which selects at least one of said first needles to knit in cooperation with at least one of said second needles when said carriage moves through said first path during the formation of at least one of the upper palm and the thunb, said at least one first needle interknittirg the at least one wale of the front ply with the at least one wale of the back ply to form the reinforced section.

2. An apparatus for knitting a glove, comprising:

a) two beds of needles, to knit fronts and backs of gloves, respectively;

b) a yarn inlay mechanism to lay yarn into the needles for knitting; and c) a control mechanism for said needles and said yarn inlay mechanism to cause said yarn inlay mechanism and said needles to cooperatively knit inlaid yarn to form a glove body of a first thickness and a crotch portion of a thickness greater than said first thickness.

3. An apparatus for forming a glove of the type having a front ply, a back ply, an upper palm having an inner edge, and a thumb having an inner edge adjacent the inner edge of the upper palm, and a reinforced section including at least one wale of the front ply interknit with a wale of the back ply along at least one of the inner edge of the upper palm and the inner edge of the thumb, said apparatus comprising:

a) a carriage movable through a first path and a second path;

b) a series of first needles operative to knit the back ply when said carriage moves through said first path;

c) a series of second needles operative to knit the front ply when said carriage moves through said second path; and c) a needle selector means for selecting, when said carriage moves through said first path during the formation of at least one of said upper palm and said thumb, at least one of said first needles to knit cooperatively with at least one of said second needles to interknit the at least one wale of the front ply with the at least one wale of the back ply to form the reinforced section.

* * * * *